US009795205B2

(12) United States Patent
Bolander et al.

(10) Patent No.: US 9,795,205 B2
(45) Date of Patent: Oct. 24, 2017

(54) DISPENSING PACKAGE

(71) Applicant: The Procter & Gamble Company, Cincinnati, OH (US)

(72) Inventors: Michael John Bolander, Loveland, OH (US); Joseph Estill Lennon, Glendale, OH (US); Songtao Zhou, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 863 days.

(21) Appl. No.: 13/652,085

(22) Filed: Oct. 15, 2012

(65) Prior Publication Data

US 2013/0039687 A1 Feb. 14, 2013

Related U.S. Application Data

(63) Continuation of application No. 12/364,233, filed on Feb. 2, 2009, now abandoned.

(51) Int. Cl.
*B43K 5/06* (2006.01)
*A45D 40/04* (2006.01)

(52) U.S. Cl.
CPC ..... *A45D 40/04* (2013.01)

(58) Field of Classification Search
CPC ..... A45D 40/04
USPC ..... 401/172–175; 4/172–175
See application file for complete search history.

(56) References Cited

U.S. PATENT DOCUMENTS

| | | | | |
|---|---|---|---|---|
| 4,331,609 A | | 5/1982 | Orr | |
| 5,000,356 A | | 3/1991 | Johnson et al. | |
| 5,547,302 A | | 8/1996 | Dornbusch et al. | |
| 5,947,621 A | * | 9/1999 | Szekely | 401/68 |
| 5,961,007 A | * | 10/1999 | Dornbusch et al. | 222/386 |
| 6,357,945 B1 | | 3/2002 | Losier et al. | |

OTHER PUBLICATIONS

International Search Report PCT/US2010/022854 dated Sep. 3, 2010, 9 pages.

* cited by examiner

*Primary Examiner* — Huyen Le
(74) *Attorney, Agent, or Firm* — Kathleen Y. Carter; James C. Vago; Betty J. Zea

(57) ABSTRACT

Dispensing packages are disclosed that are capable of dispensing soft-solid type antiperspirant compositions employing actives having a metal to chloride ratio of less than or equal to 1.3, and that are capable of exhibiting minimal weeping in between uses.

18 Claims, 3 Drawing Sheets

DISPENSING PACKAGE

FIELD OF THE INVENTION

The present invention is directed to dispensing packages that are used to apply cream or soft solid type antiperspirant and deodorant compositions to the underarm. The present invention is also directed to antiperspirant products comprising a dispensing package and an antiperspirant composition containing a high efficacy antiperspirant active.

BACKGROUND OF THE INVENTION

Swivel-up dispensing packages are typically employed for dispensing and applying cream antiperspirant compositions. Known swivel-up dispensing packages include a composition chamber, an applicator surface, a turn wheel that drives a feed screw, and an elevator threadably engaged with the feed screw, which applies pressure to the composition as it is advanced towards the applicator surface. Weeping onto the applicator surface following a normal dispensing and application event can however be an undesirable side effect of this type of dispensing package. Residual pressure within the composition remaining in the package chamber can cause the composition to weep onto the applicator surface for a period of time. U.S. Pat. No. 5,000,356 discloses a solution to weeping. The '356 patent teaches a packaging system that intermittently retracts the elevator a suitable distance following the dispensing of a discrete amount of the antiperspirant composition so that the residual pressure is relieved, thereby limiting or eliminating the weeping issue.

One of the embodiments disclosed in the '356 patent utilizes a turn wheel with an integrally formed spring that flexes to permit axial displacement of the feed screw and engaged elevator during dispensing. When the dispensing is completed, the spring, utilizing its potential energy, retracts the feed screw and elevator away from the applicator surface to relieve the residual pressure within the volume of undispensed composition.

The Procter & Gamble Company has manufactured dispensing packages in accordance with the foregoing approach for a number of years. The commercial packages utilized a one-piece turn wheel and feed screw made from an acetal resin. This is also the material disclosed in the '356 patent in connection with the above-described embodiment. The flexural modulus of acetal is sufficient to provide the retraction necessary to substantially prevent weeping. Employing acetal to manufacture a one-piece turn wheel and feed screw is acceptable for typical antiperspirant actives, but unfortunately, acetal can be susceptible to acid degradation when certain high efficacy actives are used in the antiperspirant composition. The high efficacy actives can produce a significant amount of hydrochloric acid (HCl) in the presence of water/moisture, and this acid can, in turn, degrade the screw to the point of inoperativeness. The '356 patent discloses the use of polypropylene in connection with alternative embodiments. Polypropylene is sufficiently resistant to HCL such that it would be suitable for manufacturing the feed screw. However, in a one-piece design where the turn wheel and feed screw are manufactured from the same resin, the polypropylene would be unacceptable since it possesses too low of a flexural modulus to retract the feed screw and elevator sufficiently to relieve the internal pressure necessary to sufficiently limit or prevent weeping. The present invention provides dispensing package designs that are capable of both dispensing antiperspirant compositions containing high efficacy actives and limiting or eliminating weeping.

SUMMARY OF THE INVENTION

The present invention is directed to dispensing packages suitable for dispensing cream or soft solid type antiperspirant compositions to one's underarm. In accordance with one exemplary embodiment, there has now been provided a dispensing package, comprising: (a) a container body comprising an interior chamber to contain an antiperspirant composition and an applicator surface; (b) an elevator including a cross section that is congruent to and mounted for axial movement within the chamber; and (c) an actuator system operatively connected to the elevator for advancing the elevator within the chamber to dispense a portion of the antiperspirant composition, the actuator system comprising a first section that flexes towards the applicator surface during advancement of the elevator and then rebounds away from the applicator surface to retract the elevator after the advancement, and a second section that is exposed to the antiperspirant composition. The first section is made from a polymer having a flexural modulus of from about 275 ksi to about 500 ksi and the second section is resistant to degradation by acide that can arise from a contained antiperspirant composition comprising an antiperspirant active having a metal to chloride ratio of less than or equal to 1.3.

BRIEF DESCRIPTION OF THE DRAWINGS

While the specification concludes with claims particularly pointing out and distinctly claiming the subject matter which is regarded as forming the present invention, it is believed that illustrative embodiments of the present invention may be better understood from the following description taken in conjunction with the accompanying drawings, in which:

DETAILED DESCRIPTION OF THE INVENTION

The present invention may be understood more readily by reference to the following detailed description of illustrative and preferred embodiments. It is to be understood that the scope of the claims is not limited to the specific components, methods, conditions, devices, or parameters described herein, and that the terminology used herein is not intended to be limiting of the claimed invention. Also, as used in the specification, including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent basis "about," it will be understood that the particular values form another embodiment. All ranges are inclusive and combinable.

Aspects of exemplary dispensing packages will first be described, followed by a description of antiperspirant compositions that can be dispensed by the packages.

Figure 1:
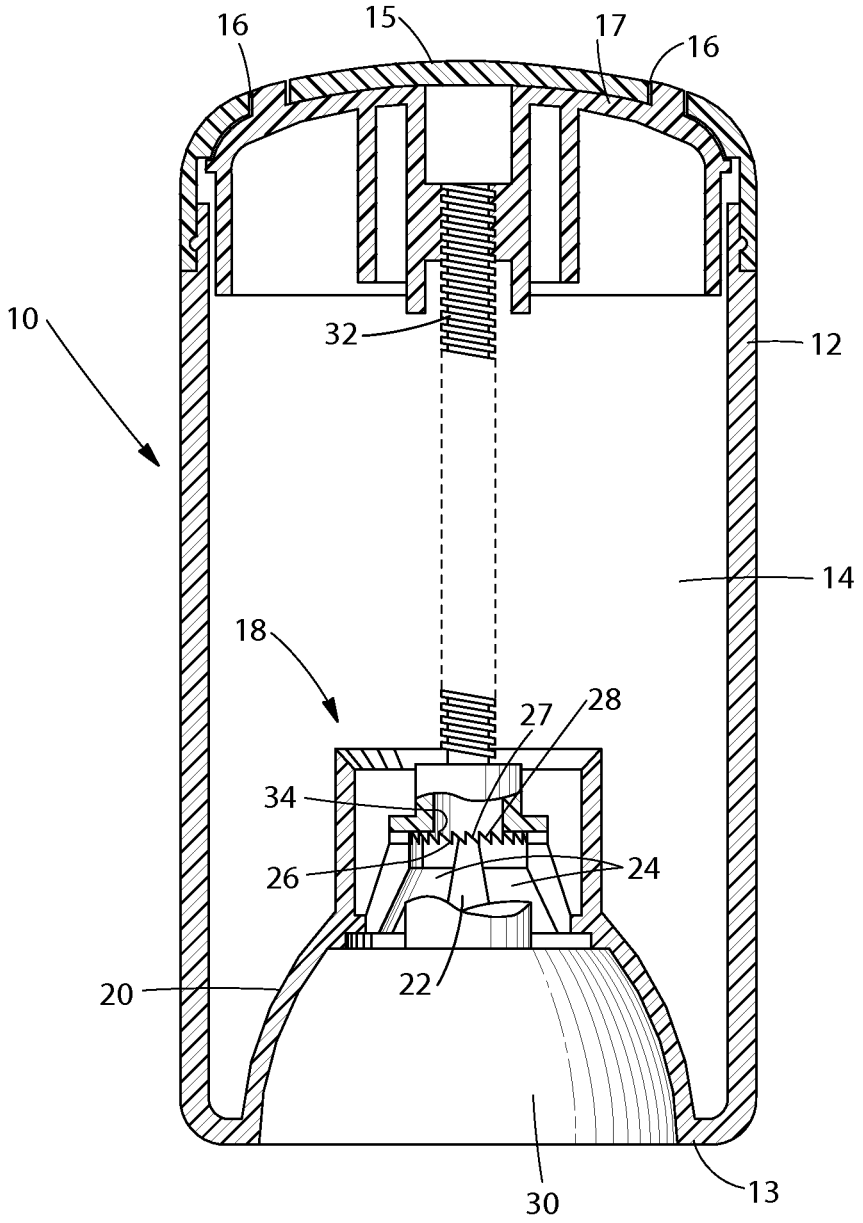
FIG. 1 is a cross-sectional view of an exemplary dispensing package embodiment provided by the present invention.
Figure 2:
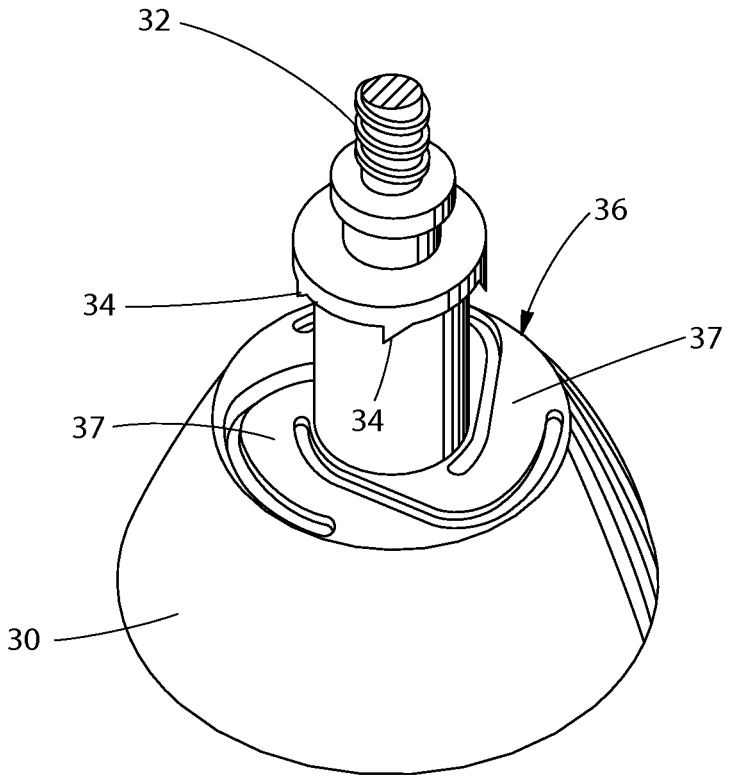
FIG. 2 is a partial perspective view of an exemplary actuator system employable in dispensing packages of the present invention.

Referring to FIG. 1, an exemplary dispensing package 10 is shown that includes a container body 12, a portion of which defines a chamber 14 for holding an antiperspirant composition, an applicator surface 15 having a plurality of through holes 16, an elevator 17, and an exemplary actuator system 18 for advancing the elevator towards applicator surface 15. Note that elevator 17 is shown in its upward most position. When chamber 14 contains a volume of an antiperspirant composition, elevator 17 will be located in a lower position than that shown in the figure.

The base 13 of container body 12 includes an arcuate section 20 that has a centrally located axially tapered hole 22 therein. Hole 22 is centered between a plurality of cantilevered fingers 24. Each of fingers 24 has one end affixed to the container body base 13 and extends upwardly towards applicator surface 16 and radially inwardly towards the central axis, terminating in a free end. The free ends of fingers 24 are disposed at an elevation above base 13 and define the circumference of the tope of hole 22. Each finger 24 is separated from adjacent fingers by slots, allowing each finger 24 to deflect independently.

Fingers 24 having fixed ends disposed about the circumference of hole 22 and which form an angle of about 70° relative to the horizontal are suitable. It will be apparent to one skilled in the art that fingers 24 can also be cantilevered from other positions of base 13 so long as they do not interfere with the movement of elevator 17. It will be further apparent that fingers 24 could be oriented at other angles, including parallel to the horizontal.

Disposed on the free end of each finger 24 is a plurality of cams 26 which may be shaped like saw tooth ratchet teeth, v-shaped, or any other profile judged to be advantageous by the skilled artisan. For the exemplary embodiment shown in the figures, cams 26 have a forward face 27 ramped from about 20° to about 50°, preferably about 40° relative to the horizontal and an abrupt secondary face 28. The free end of fingers 24 will generally accommodate several cams 26. If desired, a space or land (not shown) may be interposed between adjacent cams 26 to provide for a desired number of cams 26 on a finger 24 at a specified diameter and having a specified forward face 27 ramp angle.

A polypropylene container body 12 having an integral base 13 with a hole 22 of approximately 17.0 mm diameter and four fingers 24 extending approximately 7.8 mm in the axial direction, with free ends disposed on a diameter of approximately 11.9 mm, a circumferential dimension, or width, of approximately 6.4 mm and a radial dimension of not less than 1.9 mm has been found to work suitably.

As discussed above, exemplary actuator system 18 comprises fingers 24 and cams 26. Actuator system 18 further comprises an actuator defined by a turn wheel (interchangeably referred to as item 30) and feed screw 32. Disposed about the periphery of feed screw 32 is a plurality of ratchet teeth or followers 34 adapted to engage cams 26 disposed on the free ends of fingers 24.

Actuator or turn wheel 30 comprises a triskelion-shaped return spring 36. One exemplary manner in which return spring 36 can be incorporated into turn wheel 30 is to provide a plurality of spokes 37 extending from a central portion of turn wheel 30 to the periphery of turn wheel 30 and radiating in a spiral pattern as shown. The spokes 37 flex, allowing relative axial displacement between feed screw 32 and turn wheel 30. The spiral pattern of the spokes should be such that the spokes are tensioned as turn wheel 30 is rotated. Alternatively, it will be apparent to one skilled in the art that the return spring may be external to turn wheel 30, such as, for example, a leaf spring cantilevered from the interior of container body 12.

Figure 3:
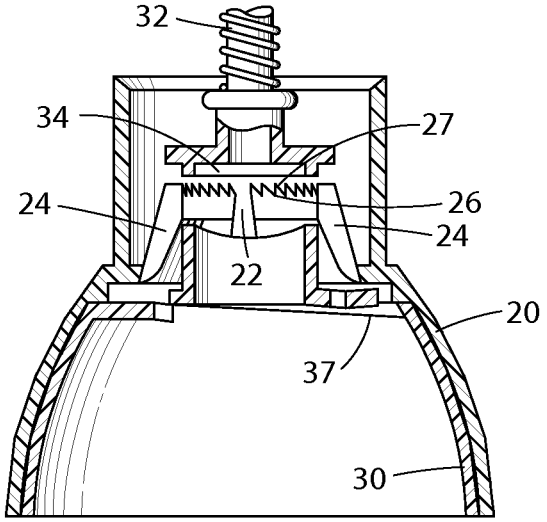
FIG. 3 is a partial side view of the exemplary actuator system shown in FIG. 2, wherein a section of the actuator system is in a flexed state that occurs during dispensing.
Figure 4:
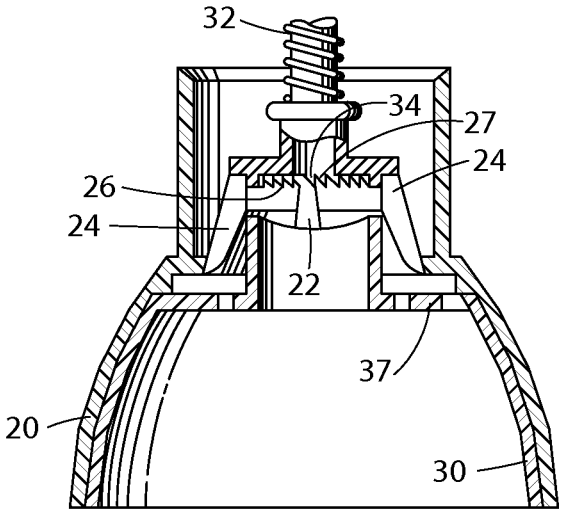
FIG. 4 is a partial side view of the exemplary actuator system shown in FIGS. 2 and 3, wherein the flexed section has returned to an un-flexed state.

In operation, as the user rotates turn wheel 30, followers 34 ride up the ramped forward cam faces 27 causing an axial displacement of feed screw 32 and elevator 17, as is shown in FIG. 3. After reaching the crest of cams 26, feed screw 32 and elevator 17 retract, via potential energy associated with return spring 36, to the proximal position as shown in FIG. 4. The superposition of the displacements resulting from the interaction of cams 26 with followers 34 and advance of the elevator 17 due to relative rotation with turn wheel 30 causes elevator 17 to advance enough to extrude some of the contained composition onto applicator surface 15, making the same available for deposition onto underarm skin. As discussed in the background section above, retraction of the feed screw and elevator relieve residual pressure from the remaining composition contained by the dispenser to limit or eliminate weeping onto the applicator surface between uses.

Dispensing packages of the present invention are designed for containing and dispensing cream or soft solid type antiperspirant compositions. The compositions generally include a carrier, a structurant/thickener, an antiperspirant active, and one or more optional ingredients, such as, for example, perfume materials, emollients, moisturizes, and residue-masking agents. Carrier materials can include, for example, a volatile silicone carrier whose concentration may be from about 20% or from about 30% but no more than about 80% or no more than about 60%, by weight of the composition. The volatile silicone may be cyclic, linear, and/or branched chain silicone. "Volatile silicone", as used herein, refers to those silicone materials that have measurable vapor pressure under ambient conditions. Non-limiting examples of suitable volatile silicones are described in Todd et al., "Volatile Silicone Fluids for Cosmetics", Cosmetics and Toiletries, 91:27-32 (1976). The volatile silicone may be a cyclic silicone having from at least about 3 silicone atoms or from at least about 5 silicone atoms but no more than about 7 silicone atoms or no more than about 6 silicone atoms. For example, volatile silicones may be used which conforms to the formula:

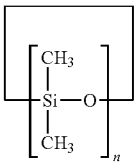

wherein n is from about 3 or from about 5 but no more than about 7 or no more than about 6. These volatile cyclic silicones generally have a viscosity of less than about 10 centistokes at 25° C. Suitable volatile silicones for use herein include, but are not limited to, Cyclomethicone D5 (commercially available from G. E. Silicones); Dow Corning 344, and Dow Corning 345 (commercially available from Dow Corning Corp.); and GE 7207, GE 7158 and Silicone Fluids SF-1202 and SF-1173 (available from General Electric Co.). SWS-03314, SWS-03400, F-222, F-223, F-250, F-251 (available from SWS Silicones Corp.); Volatile Silicones 7158, 7207, 7349 (available from Union Carbide); Masil SF-V (available from Mazer) and combinations thereof.

Suitable carrier materials can also include non-volatile organic fluids and non-volatile silicone fluids. Non-limiting examples of nonvolatile organic fluids include, but are not limited to, mineral oil, PPG-14 butyl ether, isopropyl myristate, petrolatum, butyl stearate, cetyl octanoate, butyl myristate, myristyl myristate, C12-15 alkylbenzoate, dipropylene glycol dibenzoate, PPG-15 stearyl ether benzoate and blends thereof, neopentyl glycol diheptanoate (e.g. Lexfeel 7 supplied by Inolex), octyldodecanol, isostearyl isostearate, octododecyl benzoate, isostearyl lactate, isostearyl palmitate, isononyl/isononoate, isoeicosane, octyldodecyl neopentanate, hydrogenated polyisobutane, and isobutyl stearate. Representative nonvolatile silicone fluids include those which conform to the formula:

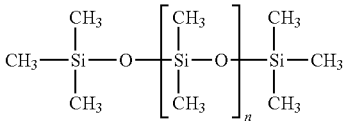

wherein n is greater than or equal to 1. These linear silicone materials may generally have viscosity values of from about 5 centistokes, from about 10 centistokes but no more than about 100,000 centistokes, no more than about 500 centistokes, no more than about 200 centistokes or no more than about 50 centistokes, as measured under ambient conditions. Specific non limiting examples of suitable nonvolatile silicone fluids include Dow Corning 200, hexamethyldisiloxane, Dow Corning 225, Dow Corning 1732, Dow Corning 5732, Dow Corning 5750 (available from Dow Corning Corp.); and SF-96, SF-1066 and SF18(350) Silicone Fluids (available from G.E. Silicones).

The antiperspirant compositions also comprise structuring/thickening agents to help provide the composition with the desired viscosity, rheology, texture and/or product hardness, or to otherwise help suspend any dispersed solids or liquids within the composition. The term "thickening agent" may include any material known or otherwise effective in providing suspending, gelling, viscosifying, solidifying or thickening properties to the composition or which otherwise provide structure to the final product form. These thickening agents may include gelling agents, polymeric or nonpolymeric agents, inorganic thickening agents, or viscosifying agents. The thickening agents may include organic solids, silicone solids, crystalline or other gellants, inorganic particulates such as clays or silicas, or combinations thereof. The concentration and type of the thickening agent selected for use in the antiperspirant composition of the present invention will vary depending upon the desired product form, viscosity, and hardness. The thickening agents may, for example, have a concentration range from at least about 0.1%, at least about 3%, or at least about 5% but no more than about 35%, no more than about 20%, or no more than about 10%, by weight of the composition. Non-limiting examples of suitable gelling agents of the present invention include fatty acid gellants, salts of fatty acids, hydroxyl acids, hydroxyl acid gellants, esters and amides of fatty acid or hydroxyl fatty acid gellants, cholesterolic materials, dibenzylidene alditols, lanolinolic materials, fatty alcohols, triglycerides, sucrose esters such as SEFA behenate, inorganic materials such as clays or silicas, other amide or polyamide gellants, and mixtures thereof.

The antiperspirant compositions of the present invention include any particulate antiperspirant active suitable for application to human skin. The concentration of antiperspirant active in the composition should be sufficient to provide the finished antiperspirant product with the desired perspiration wetness and odor control. For example, the compositions of the present invention mat contain particulate antiperspirant materials at concentrations ranging from about 0.1% to about 28% antiperspirant active by weight of the compositions, preferably from about 2% to about 22%, and more preferably from about 15% to about 20%. These weight percentages are calculated on an anhydrous unbuffered basis (exclusive of glycine, the salts of glycine, or other complexing agents). The particulate antiperspirant materials preferably have particle sizes of less than about 125 microns.

The antiperspirant active used herein has a metal to chloride molar ratio of less than or equal to about 1.3. Exemplary metal to chloride molar ratios include from about 1.3 to about 0.9, and from about 1.15 to about 1.3.

Particulate antiperspirant materials suitable for use herein are those that include any compound, composition or mixture thereof having antiperspirant activity. Astringent metallic salts are preferred antiperspirant materials for use herein, particularly the inorganic and organic salts of aluminum, zirconium and zinc, as well as mixtures thereof. Particularly preferred are the aluminum and zirconium salts, such as aluminum halides, aluminum hydroxy halides, zirconyl oxide halides, zirconyl hydroxy halides, and mixtures thereof.

Preferred aluminum salts are those represented by the formula:

$$Al_2(OH)_aCl_{b\text{-}x}H_2O$$

wherein a is from about 0 to about 4.5; the sum of a and b is about 6; x is from about 1 to about 8; and wherein a, b, and x may have non-integer values. Particularly preferred are the aluminum chlorhydroxides referred to as "¾ basic chlorhydroxide," wherein a is about 4.5, "⅔ basic chlorhydroxide," wherein a is about 4, and aluminum chloride wherein a is about 0. Processes for preparing aluminum salts are disclosed in U.S. Pat. No. 3,887,692, Gilman, issued Jun. 3, 1975; U.S. Pat. No. 3,904,741, Jones et al., issued Sep. 9, 1975; U.S. Pat. No. 4,359,456, Gosling et al., issued Nov. 16, 1982; and British Patent Specification 2,048,229, Fitzgerald et al., published Dec. 10, 1980. A general description of these aluminum salts can also be found in *Antiperspirants and Deodorants*, Cosmetic Science and Technology Series Vol. 20, 2nd edition, edited by Karl Laden. Mixtures of aluminum salts are described in British Patent Specification 1,347,950, Shin et al., published Feb. 24, 1974.

Zirconium salts are also preferred for use in the antiperspirant compositions. These salts are represented by the formula:

$$ZrO(OH)_{2-a}Cl_{a\text{-}x}H_2O$$

wherein a is from about 0.5 to about 2; x is from about 1 to about 7; and wherein a and x may have non-integer values. These zirconium salts are described in Belgian Patent 825,146, Schmitz, issued Aug. 4, 1975. Particularly preferred zirconium salts are those complexes that additionally contain aluminum and glycine, commonly known as ZAG complexes. Such ZAG complexes contain aluminum chlorhydroxide and zirconyl hydroxy chloride of the formulae described above. Preferred ZAG salts are described in U.S.

Pat. No. 4,331,609, Orr, issued May 25, 1982. Other such ZAG complexes are described in U.S. Pat. No. 3,679,068, Luedders et al., issued Feb. 12, 1974; Great Britain Patent Application 2,144,992, Callaghan et al., published Mar. 20, 1985; and U.S. Pat. No. 4,120,948, Shelton, issued Oct. 17, 1978.

Polymer size distribution of the antiperspirant actives of the compositions of the present invention can be defined by the size exclusion chromatography method as described hereinafter using Gel Permeation Chromatography (GPC). Solid antiperspirant active salts are dissolved in 0.01M nitric acid and chromatographed using 5 μl injections in a series of three consecutive Waters μ Porasil Columns, 3.9×300 mm, 10 μm packing. A 0.01M nitric acid mobile phase is employed. Chromatograms are visualized using a Waters 410 Differential Refractometer. Samples are prepared immediately prior to analysis to prevent degradation. Relative peak areas and area ratios are calculated using a Waters Millennium Data System (Version 2.10 or equivalent). The peaks observed in the chromatogram are designated in order of appearance on the chromatogram as Peaks I-II (appear as a single peak) and Peaks III, IV and V. The area of Peaks III, IV and V corresponds to the relative concentration of aluminum polymer species exiting the column during the specified time period from the injected sample. For aluminum-zirconium salts, the area of Peaks I-II corresponds to the relative concentration of co-eluting aluminum and zirconium polymer species appearing initially on the chromatogram. Prior to any analysis, the columns should be conditioned individually by repeated 100 μl injections of a 10% zirconium-aluminum tetrachlorohydrate glycine solution (containing at least 10% zirconium on a solid basis). Conditioning is complete when the area percent of Peaks I-II become relatively constant. During the conditioning process, the area percent of Peaks I-II will increase, and there will be reduction in retention for all peaks. Columns should be discarded when Peaks I and II are no longer resolved from Peak III.

Antiperspirant actives of the compositions of the present invention can have an average Peak IV area as defined by the methodology herein of at least about 7%, preferably at least about 20%, and more preferably at least about 25%.

Exemplary antiperspirant actives for use in the compositions of the present invention include aluminum chloride, aluminum dichlorohydrate, aluminum sesquichlorohydrate, aluminum zirconium tetrachlorohydrate, aluminum zirconium octachlorohydrate, aluminum zirconium tetrachlorohydrate glycine, aluminum zirconium octachlorohydrate glycine, and mixtures thereof.

Antiperspirant actives having a metal to chloride ratio of less than or equal to 1.3 are preferred due to their relatively high efficacy towards providing wetness protection. Such actives can however lead to the generation of a significant level of hydrochloric acid in the final composition when the composition is exposed to moisture (e.g., when the product stored in a high humidity environment such as a bathroom). The hydrochloric acid can degrade certain polymers associated with the dispensing package, ultimately to a point of inoperatability. Thus, dispensing packages that are suitable for delivering antiperspirant compositions employing actives with a metal to chloride ratio of less than or equal to 1.3 preferably utilize polymer resins that are resistant to attack from the HCl, at least for the packaging components that are in contact with the antiperspirant composition. Polymer resin selection for packaging components that, as discussed above, provide sufficient flexural properties is also important for dispensing packages that rely on the flexural properties to intermittently retract the elevator and feed screw to relieve the internal pressure from the antiperspirant composition to prevent/inhibit weeping. Accordingly, there are two factors that must be considered when selecting appropriate polymer resins for dispensing packages of the present invention.

An acid degradation test was employed to evaluate various resins and their suitability for use in packaging components that come into contact with antiperspirant compositions having actives with a metal to chloride ratio of less than or equal to 1.3. The test can be conducted as follows: weigh resin samples or plastic part samples made from the resin, dispense 5 ml (or other appropriate volumes for varying sample sizes) of 1M HCl into a vial, drop the samples into the vial, put the vials into a 85° C. oven for 19 hours, pull the vials from the oven and allow to cool, rinse the samples and dry the same, and then re-weigh the samples to determine weight loss as an indicator of whether or not there was acid degradation. Table 1 below shows the results of resins that were tested using this methodology, with "Pass" indicating there is no corrosion by visual inspection and/or weight loss measurement, and "Fail" indicating there is corrosion by visual inspection and/or by weight loss measurement. Features/materials that are "resistant to acid degradation", as that phrase is included in the appended claims, do not exhibit corrosion by visual inspection and/or have less than or equal to 5% (including 1% and 0%) weight loss in accordance with the above test.

A flexural modulus in the range of about 275 ksi to about 500 ksi has been found to be suitable for providing sufficient flexural properties to intermittently retract the elevator and feed screw to relieve the internal pressure from the antiperspirant composition to prevent/inhibit weeping. Polymer resins having a flexural modulus significantly below 275 ksi (e.g., Polypropylene at 214 ksi) do not appear to provide enough spring force to provide acceptable retraction to limit/inhibit weeping. The flexural modulus values shown in Table 1 below are those reported by the resin supplier. Flexural modulus is typically determined by either ASTM D790 or ISO 178 test methods.

TABLE 1

Polymer Resin Evaluation

| Material | Trade Name | Degradation Result | Flexural Modulus (ksi)/Acceptable Level For Retraction |
|---|---|---|---|
| Acrylonitrile Butadiene Styrene | Cycolac MG47 | Pass | 339/yes |
| Polyphenylene Ether + Polystyrene | Noryl 731 | Pass | 370/yes |
| Acetal | Celcon M90 | Fail | 370/yes |
| Acetal | Ultraform W2320-003 | Fail | |
| High Density Polyethylene | Dow 17450N | Pass | |
| Nylon 6/6 | Nymax 1200 A L | Pass | 425/yes |
| Talc-filled Polypropylene | Maxxam PPH-20T | Pass | 315/yes |
| Styrene Acrylonitrile | Lustran SAN 31 | Pass | 500/yes |
| Polyethylene Terephthalate Glycol | Eastar 6763 | Pass | 290/yes |
| Polypropylene | FHR P4G4Z-011 | Pass | 214/no |

As discussed above with reference to the included figures, exemplary actuator system 18 includes a feed screw 32 that is exposed to the contained antiperspirant composition, and accordingly must be sufficiently resistant to degradation from any generated HCl. Exemplary actuator system 18 also includes an actuator in the form of a turn wheel 30 that provides the spring force (via the integral triskelion-shaped spring) to retract the feed screw 32 and elevator 17 sufficiently to inhibit/eliminate weeping.

In one embodiment, two different polymer resins can be employed for the feed screw and the actuator so that the degradation and flexural modulus design criteria can be considered. For example, the feed screw can be made from a material such as polypropylene and the turn wheel made from a material such as acetal. Different manufacturing techniques can be utilized with this design approach. For example, the feed screw and turn wheel can be independently manufactured and then subsequently assembled. Or, dual injection molding techniques can be employed to mold the separate parts out of different resins. For either of these approaches, one or more rotatable molds can be employed for the molding and assembly steps. U.S. Pat. Nos. 6,783,346; 7,081,222; and 7,320,591 disclose exemplary rotatable molding and in-mold assembly techniques. In an alternative embodiment, a single polymer resin is chosen to mold both the feed screw and the actuator, wherein the chosen resin is both resistant to acid degradation and has a flexural modulus between about 275 ksi and 500 ksi. It should be appreciated that the foregoing discussion was focused on features associated with the exemplary actuator system shown in the figures, and that other actuator systems that employ different components or arrangements are also contemplated by the appended claims that should not be narrowly construed to read only on the features shown in the figures and described in connection with the same.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An antiperspirant product, comprising:

a dispensing package comprising a container body comprising an interior chamber containing an antiperspirant composition, an applicator surface, an elevator axially movable within the interior chamber, and an actuator system comprising a feed screw threadably connected to the elevator, a turn wheel, and a return spring that permits relative axial displacement between the feed screw and the turn wheel, wherein rotation of the turn wheel advances the elevator toward the applicator surface;

an antiperspirant composition disposed within the interior chamber and exposed to the feed screw, the antiperspirant composition comprising an antiperspirant active having a metal to chloride ratio less than or equal to 1.3; and wherein the feed screw, turn wheel and return spring are molded from a polymer having a flexural modulus from about 275 to about 500 and being resistant to acid degradation;

wherein the polymer is selected from the group consisting of acrylonitrile butadiene styrene, blend of polyphenylene ether and polystryrene, high density polyethylene, nylon, styrene acrylonitrile, polyethylene terephthalate glycol, polybutylene terephthalate, and mixtures thereof.

2. The antiperspirant product of claim 1, wherein the antiperspirant active comprises a zirconium salt complex.

3. The antiperspirant product of claim 1, wherein the polymer is a blend of polyphenylene ether and polystryrene.

4. The antiperspirant product of claim 1, wherein the return spring retracts the feed screw and elevator so that weeping of the antiperspirant composition onto the applicator surface is minimized.

5. The antiperspirant product of claim 1, wherein the return spring is triskelion shaped spring.

6. The antiperspirant product of claim 1, wherein the antiperspirant active has a metal to chloride ratio from about 1.15 to about 1.3.

7. The antiperspirant product of claim 1, wherein the turn wheel and return spring are integrally formed.

8. The antiperspirant product of claim 1, wherein the turn wheel, return spring and feed screw are formed as one piece.

9. The antiperspirant product of claim 1, wherein the antiperspirant composition generates hydrochloric acid in the presence of water.

10. The antiperspirant product of claim 1, wherein turn wheel, return spring and feed screw are made from a polymer that is not polypropylene or acetal.

11. The antiperspirant product of claim 1, wherein the actuator system further comprises a plurality of cams, each of the plurality of cams having a crest, a plurality of followers that engage the plurality of cams, and wherein rotation of the turn wheel causes the plurality of followers to ride up the plurality of cams thereby causing an axial displacement of the feed screw and elevator.

12. The antiperspirant product of claim 11, wherein the return spring retracts the feed screw and elevator after the plurality of followers reach the crests of the plurality of cams.

13. An antiperspirant product, comprising:

a dispensing package comprising a container body comprising an interior chamber containing an antiperspirant composition, an applicator surface, an elevator axially movable within the interior chamber, and an actuator system comprising a feed screw threadably connected to the elevator, a turn wheel whose rotation turns the feed screw to advance the elevator toward the applicator surface, and a return spring that permits relative axial displacement between the feed screw and the turn wheel, wherein the feed screw, return spring and turn wheel are formed as one piece and wherein the return spring retracts the feed screw and elevator so that weeping of the antiperspirant composition onto the applicator surface is minimized;

an antiperspirant composition disposed within the interior chamber and exposed to the feed screw, the antiperspirant composition comprising an antiperspirant active having a metal to chloride ratio from about 1.15 to about 1.3; and wherein the feed screw, turn wheel and return spring are molded from a polymer having a flexural modulus from about 275 to about 500 and being resistant to acid degradation;

wherein turn wheel, return spring and feed screw are made from a polymer that is not polypropylene or acetal.

14. The antiperspirant product of claim 13, wherein the polymer is selected from the group consisting of acrylonitrile butadiene styrene, blend of polyphenylene ether and polystryrene, high density polyethylene, nylon, styrene acrylonitrile, polyethylene terephthalate glycol, polybutylene terephthalate, and mixtures thereof.

15. The antiperspirant product of claim 14, wherein the antiperspirant active comprises a zirconium salt complex.

16. The antiperspirant product of claim 15, wherein the antiperspirant composition generates hydrochloric acid in the presence of water.

17. The antiperspirant product of claim 13, wherein the actuator system further comprises a plurality of cams, each of the plurality of cams having a crest, a plurality of followers that engage the plurality of cams, and wherein rotation of the turn wheel causes the plurality of followers to ride up the plurality of cams thereby causing an axial displacement of the feed screw and elevator.

18. The antiperspirant product of claim 17, wherein the return spring retracts the feed screw and elevator after the plurality of followers reach the crests of the plurality of cams.

* * * * *